United States Patent [19]

Dlugopolski

[11] 4,231,472

[45] Nov. 4, 1980

[54] OUTER MAILING JACKET

[75] Inventor: Joseph Dlugopolski, Lombard, Ill.

[73] Assignee: Fidelity Container Corporation, Elk Grove Village, Ill.

[21] Appl. No.: 963,337

[22] Filed: Nov. 24, 1978

[51] Int. Cl.[3] ..... B65D 85/30; B65D 85/57

[52] U.S. Cl. ..... 206/309; 206/424; 229/40; 229/92

[58] Field of Search ..... 206/309, 311, 312, 313, 206/424; 229/40, 92, 87 R

[56] References Cited

U.S. PATENT DOCUMENTS

| | | | |
|---|---|---|---|
| 3,116,005 | 12/1963 | Skaggs | 206/309 |
| 3,203,618 | 8/1965 | Andrews et al. | 229/40 |
| 3,386,642 | 6/1968 | Young | 229/40 |
| 3,455,499 | 7/1969 | Anderson | 229/40 |
| 3,465,946 | 9/1969 | Johnson | 229/40 |
| 3,682,370 | 8/1972 | Rous | 229/40 |
| 3,720,366 | 3/1973 | Martin | 229/40 X |
| 3,790,065 | 2/1974 | Carpenter | 206/424 |
| 3,841,548 | 10/1974 | Curley | 229/40 |
| 3,884,352 | 5/1975 | Pilz et al. | 229/40 |

*Primary Examiner*—Joseph Man-Fu Moy

*Attorney, Agent, or Firm*—Laff, Whitesel & Rockman

[57] ABSTRACT

An outer mailing jacket is made from a folded sheet of suitable material, such as corrugated cardboard. The jacket has corner panels for centrally positioning a product enclosed therein. The mailing jacket is especially designed for receiving and supporting phonograph records, without danger that a staple used to close the jacket might damage the record.

8 Claims, 3 Drawing Figures

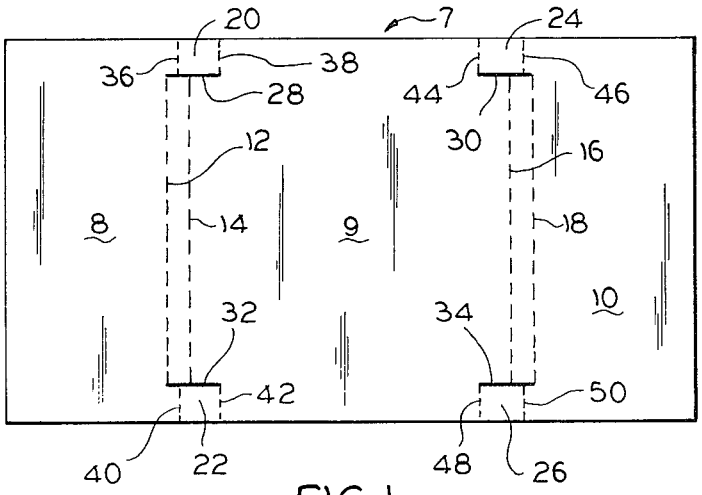
FIG.1
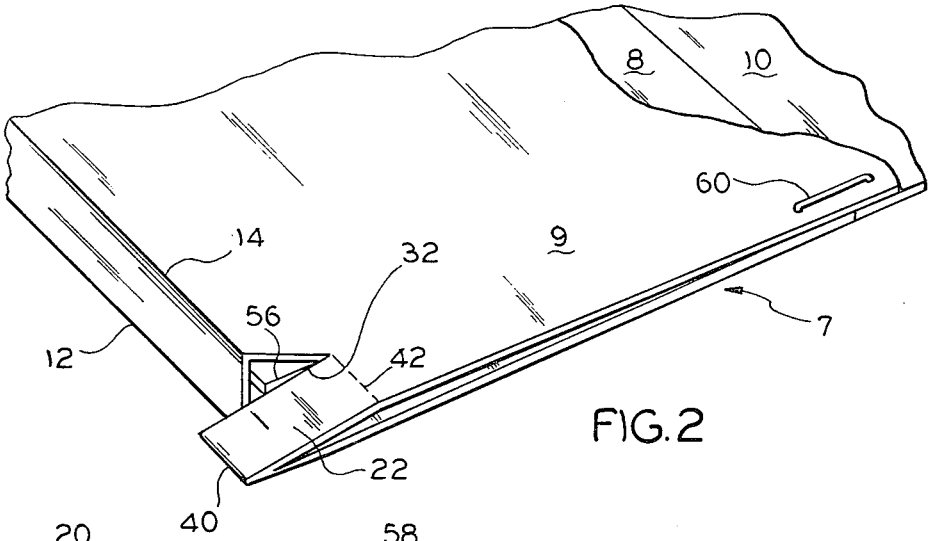
FIG.2
FIG.3
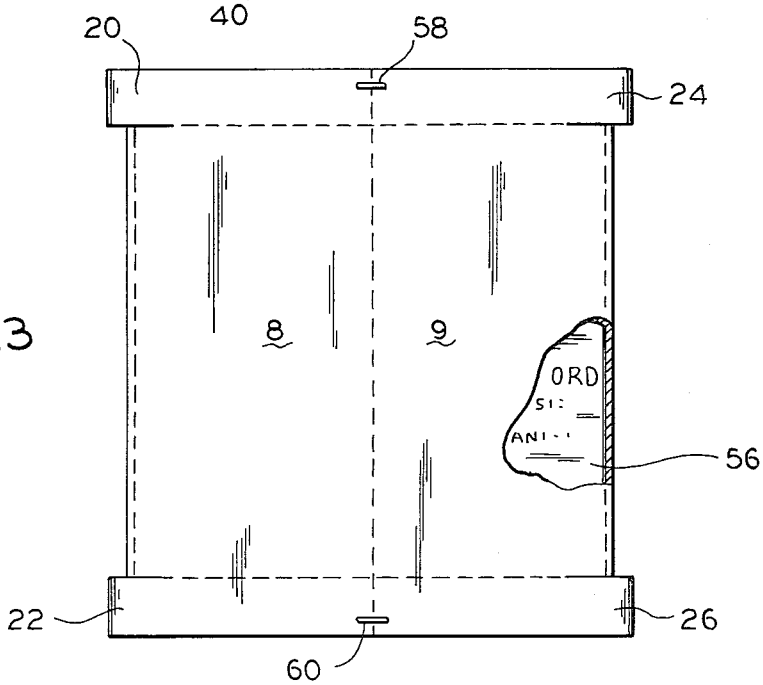

OUTER MAILING JACKET

The invention relates to folding boxes and, more particularly, to low-cost mailing jackets for large flat products.

Many relatively large, flat, thin and fragile products must be packaged to withstand rough handling, as when shipped through the mails or transported by other similar carriers. These products generally have a relatively low cost, so that the packages for adequately protecting them could amount to a significant percentage of the total product cost. Also, many of these products are often shipped out simultaneously in very large quantities. Therefore, machinery is required to insert the products into their mailing jackets, or other boxes, if handling costs are not to become prohibitive.

Exemplary of the products which illustrate these and similar problems are phonograph records mailed by large record clubs. Each month, they send out thousands of the same records. Therefore, they may stack the records in an almost completely unattended machine which wraps, seals, and delivers them for mailing.

The simplest packaging arrangement for a phonograph record, or the like, is merely to provide a rectangular sheet of corrugated cardboard or any equivalent material. A jacketed phonograph record is placed in the middle of this rectangular sheet and then its two sides are folded over the top of the record jacket and one staple is inserted through each end of the resulting box, to hold it together. A difficulty is that, if the phonograph record shifts slightly as the rectangular sheet is being folded, the staple may go through the record.

Accordingly, an object of the invention is to provide new and improved means for and methods of shipping large, flat objects. In particular, an object is to provide mailing jackets for phonograph records or albums of records.

Another object of the invention is to provide new and improved means for automatically inserting phonograph records in outer mailing jackets preparatory for mailing. In this connection, an object is to provide folding cardboard blanks for outer mailing jackets which are especially well-suited for use in automatic boxing machines. Here, an object is to provide outer mialing jackets which automatically center the enclosed phonograph record so that it cannot be damaged by a staple positioned on an edge of the box.

In keeping with an aspect of the invention, these and other objects are accomplished by providing a folding cardboard blank having a double row of perforations forming preferred lines of folding along each jacket side, in order to form jacket panels. Before it reaches the edge of the blank, each of these double rows of perforations terminates in an offset panel which is not aligned with any other jacket panel. When the blank folds along the two perforated lines, the offset panels tip to set at an acute angle with respect to other blank panels and thereby provide a barrier which keeps the phonograph album from shifting. This way, the offset panel centers a record jacket within the folded blank so that it will not be damaged by staples inserted through the edge of the jacket.

A preferred embodiment of the invention is seen in the attached drawings, wherein:

FIG. 1 is a plan view of a blank for making the outer mailing jacket;

FIG. 2 is a perspective view of a corner of a box formed by folding the jacket blank, showing how an offset panel tips up to set at an angle with respect to other blank panels and thereby form a barrier for centering a record jacket; and FIG. 3 is a plan view of a record in a completed mailing jacket.

The inventive outer mailing jacket is made from a simple rectangular blank 7 which is slightly wider and about twice as long as a phonograph record jacket or album. The blank 7 is divided into a series of three panels 8,9,10 by two pairs of major fold lines 12,14,16,18, which are formed transversely across almost the entire width of the blank 10. These fold lines 12–18 are at the positions (setting off approximately a quarter of the total panel) where the blank folds to form side panels of a box which encloses a phonograph record when the two outside panels 8,10 fold over the center panel 9. In this embodiment, each fold line is a perforated line.

Before it reaches the edge of the blank, each end of the perforated lines 12,14,16,18 terminates in an offset panel 20,22,24,26. The outer edge of each of the offset panels is the outer edge of the rectangular blank 10. The inner edges of these offset panels are defined by cut lines 28,30,32,34 which pierce the blank. The two ends of each offset panel are fixed by two spaced parallel, perforated, minor fold lines 36–50.

The term "offset" panel is used to describe panels 20–26 because the major perforated fold lines 12–18 are not aligned with the minor perforated fold lines 36–50. Therefore, when panels 8,10 fold along lines 12–18 and over panel 9, the offset panels must tip to set at an angle with respect to other blank panels, because they fold along offset lines 36–50.

This is seen in FIG. 2, where a single exemplary corner of the folded jacket is shown. The blank 7 is folded at major perforated lines 12,14 so that the jacket end panel 8 comes to rest over the center jacket panel 9. As this folding occurs, the offset panel 22 folds along minor perforated lines 40,42. Since the offset panel 22 is wider than the space between perforated lines 12,14 and, since the lines 40,42 do not align with the lines 12,14, the panel 22 tips to set at an angle with respect to other blank panels. The tipped corner panels 20–26 act as a barrier at the corners of the outer jacket to center the conventional record jacket 56 enclosed inside the out mailing jacket. Thus, the conventional record jacket is centered, held and restrained from approaching the edges of the box.

Staples 58,60 secure the edges of the two side panels 8,10 to the back panel 9. Since the offset panels 20–26 prevent the record jacket 56 from moving away from the central location within the inventive mailing jacket, there is no way that the staples 58,60 can damage the record.

Those who are skilled in the art will readily perceive how to modify the system. Therefore, the appended claims are to be construed to cover all equivalent structures which fall within the true scope and spirit of the invention.

I claim:

1. An outer mailing jacket comprising a rectangular blank having a series of three major panels extending across the full width of said rectangle, each major panel being defined by two pairs of double, spaced parallel, fold lines extending transversely across substantially the entire blank, the spaces between the double fold lines defining the side panels of a box made by folding the two outside panels of said series over the center panel of said series, each of said fold lines terminating at their opposite ends in cut lines before said fold lines reach the edge of the rectangular blank, and non-folding offset panel means within said rectangle, each of said cut lines beginning at one of said parallel fold lines and extending beyond the associated parallel fold line, one side of said offset panel being defined by said cut line, and an opposite side of said offset panel being defined by an edge of said blank, one end of said offset panel being defined by a fold line positioned between said spaced parallel fold lines, the other end of said offset panel being defined by a fold line at the end of said cut line which extends beyond said associated parallel fold line, said offset panel means tipping to form an acute angle with respect to other panels when the blank is folded whereby said offset angle forms a barrier to prevent an object from sliding out of said jacket.

2. The jacket of claim 1 and means for securing the two outside panels to the center panel after said blank is folded, thereby completing a box.

3. A folding blank for forming an outer mailing jacket comprising a generally rectangular panel having two pairs of spaced parallel major fold lines extending transversely across the panel, each of said pairs of major fold lines setting off approximately one quarter of the total rectangular panel area on opposite ends of the blank, the space between each of the pairs of major fold lines being equal to the width of a desired side panel, each end of said pairs of major fold lines terminating perpendicularly at a cut line which is in a spaced parallel relationship to the edge of the blank, said cut line beginning at one of the paired major fold lines and projecting beyond the other of the paired major fold lines, and a pair of minor fold lines associated with each of said cut lines, one of said paired minor fold lines extending from the space between the associated major fold lines to the side edge of the blank and the other of said paired fold lines extending from the projected end of said cut line to the side edge of said blank, the distance between the major fold lines being less than the distance between the minor fold lines.

4. The blank of claim 3 wherein the transverse space between said cut lines is slightly greater than the width of a phonograph record jacket.

5. The blank of claim 4 wherein the distance between said side edge and said cut line is determined by the position of a staple used to close the blank when folded along said major fold lines.

6. The blank of claim 3 wherein the distances between said spaced parallel, major fold lines and paired minor fold lines are interrelated so that panels defined by said cut and minor fold lines tip to form an acute angle with respect to the central space between each of the pairs of major fold lines when the rectangular panel areas on opposite ends of the blank are folded over the central space.

7. A process for packaging phonograph records for shipment comprising the steps of:

a. forming a rectangular blank having within its perimeter a series of three panels with four offset panels at the corners of the center panel in said series, the width of the center one of said three panels being approximately equal to the combined widths of the two outside panels, the three panels in said series being separated by two pairs of double, spaced parallel, fold lines which terminate at their opposite ends in cut lines which are longer than the distance between the spaced parallel fold lines, said cut lines cooperating with edges of said blank to form opposing sides of non-folding offset panels, the opposite ends of said non-folding offset panels being defined by minor fold lines, one of which is located between said spaced parallel, fold lines and the other of which is located at the end of said cut lines;

b. forming said non-folding offset panels to set at an acute angle with respect to the series of panels when said series of three panels are folded into a face-to-face relationship;

c. positioning a phonograph record over said center panel in a location which is centered by said offset panels when they are positioned at said acute angle;

d. folding the two outside panels over said center panel to enclose said phonograph record while it is being held in said centered position by said offset panels; and e. fastening to said center panel, the outside panels folded during step c.

8. The process of claim 7 wherein the fastening of step e. comprises driving a staple with one of its legs penetrating one of the outside panels and the center panel, and the other of its legs penetrating the other of the outside panels and the center panel.

* * * * *